United States Patent [19]

Ragland, Jr.

[11] Patent Number: 5,063,325

[45] Date of Patent: Nov. 5, 1991

[54] COLOR PICTURE TUBE HAVING IMPROVED SHADOW MASK-FRAME ASSEMBLY SUPPORT

[75] Inventor: Frank R. Ragland, Jr., Lancaster, Pa.

[73] Assignee: Thomson Consumer Electronics Inc., Indianapolis, Ind.

[21] Appl. No.: 494,364

[22] Filed: Mar. 16, 1990

[51] Int. Cl.[5] ..... H01J 29/07

[52] U.S. Cl. ..... 313/405; 313/407

[58] Field of Search ..... 313/405, 406, 407

[56] References Cited

U.S. PATENT DOCUMENTS

| | | | |
|---|---|---|---|
| 3,529,199 | 9/1970 | Duistermaat et al. | 313/85 |
| 3,700,948 | 10/1972 | Palac | 313/405 |
| 4,317,064 | 2/1982 | Dougherty | 313/406 |
| 4,723,088 | 2/1988 | Sone et al. | 313/404 |
| 4,728,853 | 3/1988 | Sone et al. | 313/406 |
| 4,827,180 | 5/1989 | Sone et al. | 313/404 |

FOREIGN PATENT DOCUMENTS

| | | | |
|---|---|---|---|
| 0934804 | 10/1973 | Canada | 313/405 |
| 0000859 | 1/1979 | Japan | 313/405 |

*Primary Examiner*—Donald J. Yusko

*Assistant Examiner*—Nimeshkumar D. Patel

*Attorney, Agent, or Firm*—Joseph S. Tripoli; Dennis H. Irlbeck

[57] ABSTRACT

The improved color picture tube includes an evacuated glass envelope having a rectangular faceplate panel. The panel includes a shadow mask assembly mounted therein by support means that are located at peripherally spaced positions within the panel. The support means provide compensation for thermal expansion of the shadow mask assembly. The compensation is a movement of the shadow mask assembly toward a screen of the tube as the shadow mask assembly expands. The support means at each of the spaced positions includes a stud attached to the glass envelope, a spring having an aperture therein engaging the stud, and a plate welded between the spring and the shadow mask assembly. The improvement comprises the combination of the spring being angled with respect to the shadow mask assembly to provide approximately half of the required compensation, and the plate being constructed of bimetallic materials and being of appropriate thickness and length to provide the approximately remaining half of the required compensation.

3 Claims, 2 Drawing Sheets

COLOR PICTURE TUBE HAVING IMPROVED SHADOW MASK-FRAME ASSEMBLY SUPPORT

This invention relates to color picture tubes of the type having a shadow mask attached to a peripheral frame which is suspended in relation to a cathodoluminescent screen and, particularly, to improved means for suspending a mask-frame assembly in such a tube.

BACKGROUND OF THE INVENTION

In most current color picture tube types, a peripheral frame supporting a shadow mask is suspended in a faceplate panel by means of springs that are welded either directly to the frame or to plates which in turn are welded to the frame. In the directly welded version, the springs are usually made of bimetallic materials; and in the plate version, the plates are bimetallic. As the springs or plates become heated by transfer of heat from the mask through the frame, the bimetallic materials expand differently, thereby bending the springs or plates to cause movement of the mask-frame assembly toward a screen disposed on the panel. It is also known to use the geometric structure of the springs to cause this same motion towards the screen by action of the force of the expanding mask-frame assembly against the springs.

It is common to use either three or four springs to support a mask-frame assembly within a rectangular faceplate panel of a tube. In a three-spring support system, one spring is usually located at the upper center of the mask, and the other two springs are located along the sides of the tube between the centers of the sides of the mask and the lower two corners of the mask. In a four-spring support system, springs are usually located at the top and bottom centers of the mask and at the left and right centers of the mask. In both the three- and four-spring support systems, as described above, it is possible for the mask-frame assembly to twist slightly and shift relative to the faceplate, during tube manufacture and/or operation.

A known means for minimizing twisting and shifting of a mask-frame assembly uses spring supports at the four corners of the frame. Embodiments for achieving such corner support are shown in U.S. Pat. No. 4,723,088, issued to Sone et al. on Feb. 2, 1988, and in U.S. Pat. No. 4,728,853, issued to Sone et al. on Mar. 1, 1988.

U.S. Pat. No. 4,723,088 shows a mask frame having truncated corners with supports at each corner. The supports are bent plates including three sections. A first section is welded to the frame. A second section extends at an angle from the first section toward a skirt of a faceplate panel. A third section extends from the second section and includes an aperture that engages a metal stud embedded in the panel sidewall.

U.S. Pat. No 4,728,853 discloses a mask-frame assembly support which includes two members welded together. One member, having a flat plate shape, is welded at several separated points to a mask frame. The second member includes three sections. A first section is welded to the first member. A second section angles from the first section, and an apertured third section engages a support stud in the panel sidewall.

A problem encountered with many prior art support systems is that they may shift when subjected to shock and vibration. Therefore, there is a need for improvements in mask support systems that will reduce their susceptibility to such shifts.

The present invention provides an improvement in tubes, using the mask-frame assembly support systems of the above-identified patents, that is less affected by shock and vibration.

SUMMARY OF THE INVENTION

The improved color picture tube includes an evacuated glass envelope having a rectangular faceplate panel. The panel includes a shadow mask assembly mounted therein by support means that are located at peripherally spaced positions within the panel. The support means provide compensation for thermal expansion of the shadow mask assembly. The compensation is a movement of the shadow mask assembly toward a screen of the tube as the shadow mask assembly expands. The support means at each of the spaced positions includes a stud attached to the glass envelope, a spring having an aperture therein engaging the stud, and a plate welded between the spring and the shadow mask assembly. The improvement comprises the combination of the spring being angled with respect to the shadow mask assembly to provide approximately half of the required compensation, and the plate being constructed of bimetallic materials and being of appropriate thickness and length to provide the approximately remaining half of the required compensation.

DETAILED DESCRIPTION OF THE PREFERRED EMBODIMENTS

Figure 1:
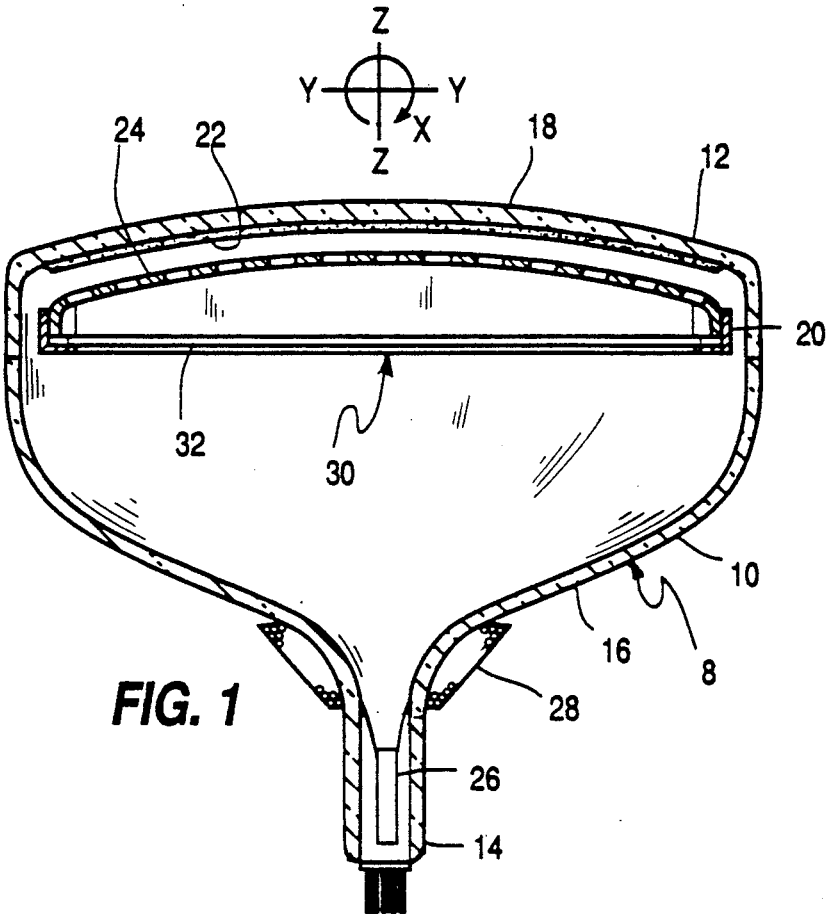
FIG. 1 is an axially sectioned side view of a color picture tube embodying the present invention.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12 includes two orthogonal axes: a major axis X, parallel to its wider dimension (usually horizontal), and a minor axis Y, parallel to its narrower dimension (usually vertical). The major and minor axes are perpendicular to the central longitudinal axis Z of the tube which passes through the center of the neck 14 and the center of the panel 12. A mosaic three-color phosphor screen 22 is carried by the inner surface of the faceplate 18. The screen preferably is a line screen with the phosphor lines extending substantially parallel to the minor axis Y. Alternatively, the screen may be a dot screen. A multiapertured color selection electrode or shadow mask 24 is removably mounted, by improved means, in predetermined spaced relation to the screen 22. An electron gun 26 is centrally mounted within the neck 14, to generate and direct three electron beams along convergent paths through the mask 24 to the screen 22.

The tube of FIG. 1 is designed to be used with an external magnetic deflection yoke, such as the yoke 28, located in the vicinity of the funnel-to-neck junction. When activated, the yoke 28 subjects the three beams to magnetic fields which cause the beams to scan horizontally and vertically in a rectangular raster over the screen 22.

Figure 2:
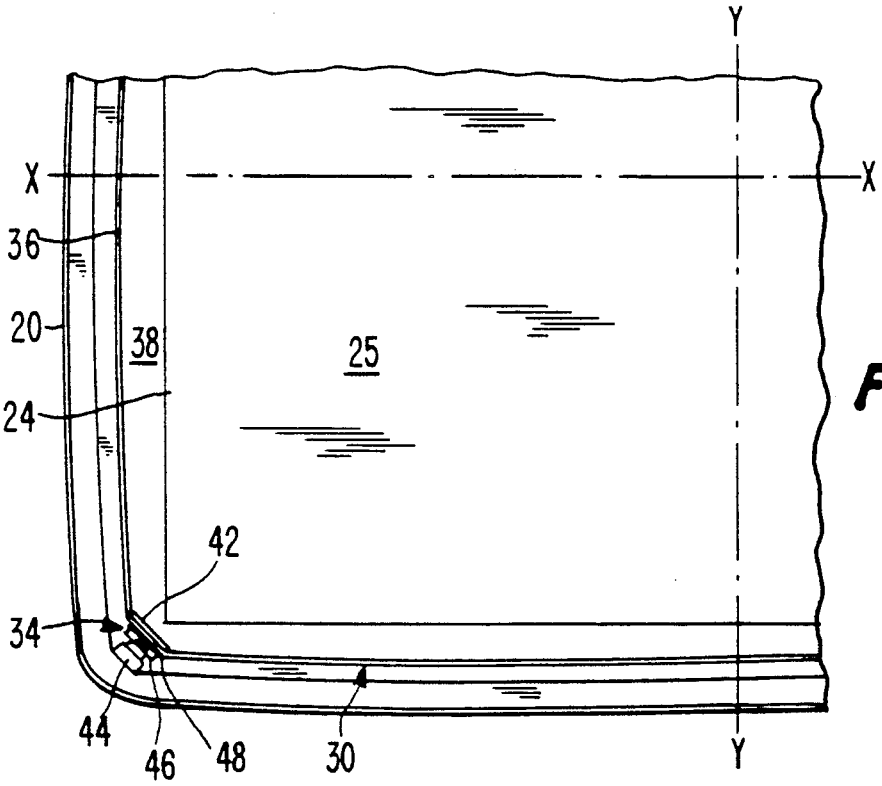
FIG. 2 is a bottom view of a quadrant of the faceplate panel and mask-frame assembly of the tube of FIG. 1.

The shadow mask 24 is part of a mask-frame assembly 30 that also includes a peripheral frame 32. The mask-frame assembly 30 is shown positioned within the faceplate panel 12 in FIGS. 1, 2 and 3. The mask-frame assembly 30 is mounted to the panel 12 by four improved support means 34 shown in FIGS. 2 and 3.

The frame 32 includes two substantially perpendicular flanges, a first flange 36 and a second flange 38, in an L-shaped cross-sectional configuration. The first flange 36 extends from the second flange 38 in a direction toward the screen 22. The second flange 38 extends from the first flange 36 in a direction toward the central longitudinal axis Z of the tube 8. The four corners 42 of the frame 32 are truncated, being angled approximately perpendicularly to the diagonal directions of the frame.

The shadow mask 24 includes a curved apertured portion 25, an imperforate border portion 27 surrounding the apertured portion 25, and a skirt portion 29 bent back from the border portion 27 and extending away from the screen 22. The mask 24 is telescoped within or set inside the frame 32 and welded to the inside surface of the first flange 36.

Mask-frame assembly support means 34 are included at each of the four corners of the frame and panel. Each support means 34 includes a stud 44, a spring 46 and a plate 48. Each stud 44 is a conically-shaped metal member that is attached to the panel sidewall 20. Each plate 48 is welded near one end to the flange 36 at a truncated corner of the frame 32. The spring 46 is attached at one of its ends to the other end of the plate 48. An aperture 50, near the free end of each spring 46, engages the conical portion of a stud 44.

The spring 46 includes three portions 52, 54 and 58. A first portion 52 parallels the plate 48 and is welded thereto. An elongated second portion 54 extends from the first portion 52 and forms an acute angle $\beta$ with a plane C that parallels the central longitudinal axis Z of the tube. A third portion 58 extends from the second portion 54 and is approximately perpendicular to the central longitudinal axis A of the stud 44. The third portion 58 has a circular embossed section 60 that includes a centered aperture 50. In this embodiment, the embossed section 60 provides an offset. Because of this offset, the elongated second portion 54 is aligned with the center of the aperture 50, so that a central longitudinal plane B of the second portion 54 crosses the central longitudinal axis A of the stud 44 approximately at the center of the aperture 50. This offset eliminates an undesirable lever arm that would be present in a spring without the offset because of misalignment of the elongated second portion 54 with the spring aperture-stud contact.

Figure 3:
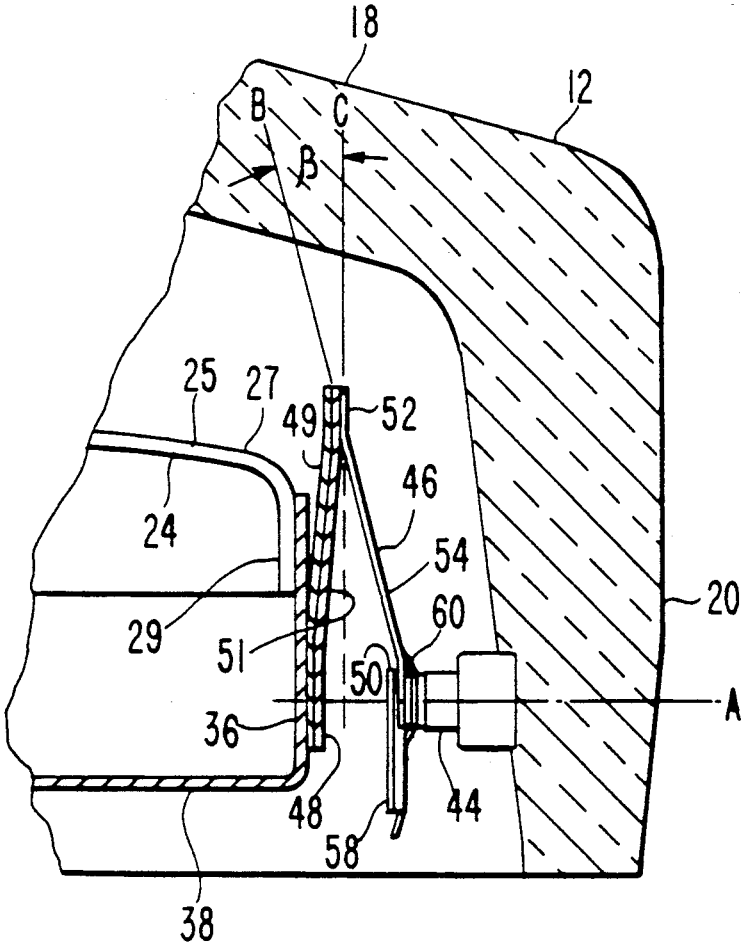
FIG. 3 is a plan view of a spring, plate and stud in accordance with the present invention.

The plate 48, sometimes also referred to as the clip, is of laminated bimetallic construction as shown by the cross-sections in FIG. 3. One metal layer 49, facing the frame, is a high thermal expansion material, and the other metal layer 51, facing the spring, is a low thermal expansion material.

The spring 46 and the plate 48 each contribute approximately half of the compensation necessary to move the mask relative to the screen to compensate for thermal expansion of the mask during tube operation. Such compensation is required to keep the mask apertures aligned with the phosphor elements of the screen along the electron beam paths. The contribution of the spring to this compensation is a geometric one which is caused by the force of the expanding mask against the spring. The amount of geometric compensation provided by the spring is related to the angle $\beta$ that the second portion 54 of the spring makes with the plane C. The amount of thermal compensation provided by the plate is related to the thickness of the plate and to the relative difference in thermal expansion coefficients of the metal layers 49 and 51.

In a preferred embodiment for a tube having a $4\times3$ aspect ratio and a 31 inch (79 cm) rectangular viewing screen diagonal, a 0.025 inch (0.0635 cm) thick spring of Carpenter Custom 455 stainless steel having a $\beta$ angle of 15 degrees is used in combination with a 0.073 inch (0.1854 cm) thick by 1.246 inch (3.165 cm) long bimetal plate, for a steel shadow mask and with a 0.062 inch (0.1575 cm) thick by 1.246 inch (3.165 cm) long bimetal plate for an Invar shadow mask. In another embodiment for both a tube having a $16\times9$ aspect ratio and a 34 inch (86 cm) rectangular viewing screen diagonal and a tube having a $4\times3$ aspect ratio and a 35 inch (89 cm) rectangular viewing screen diagonal, a 0.031 inch (0.0787 cm) thick spring of Carpenter Custom 455 stainless steel having a $\beta$ angle of 15 degrees is used in combination with a 0.060 inch (0.1524 cm) thick by 1.530 inch (3.886 cm) long bimetal plate. The Carpenter Custom 455 stainless steel was selected over other metals because of its better response to the heat treatments encountered during tube processing. The bimetal plates are of high expansion 300 series stainless steel and low expansion Invar.

Full geometric compensation for mask expansion could be made in a tube by increasing the angle $\beta$ in the spring until the plane B of the second portion 54 of the spring was approximately perpendicular to the electron beam path at maximum deflection. However, the difficulty with a spring angle this large is that the mechanical forces and moments, as well as the commensurate stress levels experienced by the spring during shock, are unacceptably high. Therefore, the use of full geometric compensation is undersirable. Full thermal compensation utilizing the plates also is undesirable, but for a substantially different reason. If full compensation is made using a bimetallic plate, the structure of the mask support means would have to be substantially modified. As yet, no alternative support means has been developed that can meet the various force, moment, stress and shock requirements encountered during tube operation as well as the design shown in FIG. 3.

Although the present invention has been described with respect to a tube having a corner-mounted shadow mask therein, it should be understood that the invention may alternatively be applied to a tube having a shadow mask mounted along the major and minor axes within a tube faceplate panel. Futhermore, the present invention may be applied to a tube in which peripheral reinforcement of a shadow mask is provided integrally with the mask, without use of a separate frame. In addition, the present invention may be applied to a mask support system having other than four support locations. Herein, the term "approximately half" is used. This term should be taken broadly and encompasses 50% plus or minus 15%.

What is claimed is:

1. In a color picture tube including an evacuated glass envelope having a rectangular faceplate panel, said panel including a shadow mask assembly mounted therein by support means located at peripherally spaced positions within said panel, said support means providing thermal compensation for expansion of said shadow mask assembly, the thermal compensation being a movement of said shadow mask assembly toward a screen of said tube as the shadow mask assembly expands, said support means at each of said spaced positions including a stud attached to said glass envelope, a spring having an aperture therein engaging said stud, and a plate welded between said spring and said shadow mask assembly, the improvement comprising the combination of said spring being angled with respect to said shadow mask assembly to provide approximately half of the required compensation, and said plate being constructed of bimetallic materials and being of appropriate thickness and length to provide the approximately remaining half of the required compensation.

2. The tube as defined in claim 1, wherein said support means are located at the corners of said rectangular faceplate panel.

3. The tube as defined in claim 1, wherein said spring includes a first portion connected to said plate, an elongated second portion extending from said first portion, and a third portion extending from said second portion, said third portion having an embossed section offsetting a part of the third portion from the remainder of the third portion, the offset part of the third portion including said aperture.

* * * * *